US007510086B2

(12) United States Patent
Henssler et al.

(10) Patent No.: US 7,510,086 B2
(45) Date of Patent: Mar. 31, 2009

(54) SEALING ARRANGEMENT

(76) Inventors: Joachim Henssler, Franz-Joachim-Beich Str. 19, 88213 Ravensburg (DE); Christoph Haase, Habersdorf 3, 3041 Asperhofen (AT); Herbert Boden, Spratzerner Kirchenweg, 108/7, 3100 St. Pölten (AT); Helena Johansson, Schmittenstrasse 8, 89522 Heidenheim (DE)

( * ) Notice: Subject to any disclaimer, the term of this patent is extended or adjusted under 35 U.S.C. 154(b) by 230 days.

(21) Appl. No.: 11/565,904

(22) Filed: Dec. 1, 2006

(65) Prior Publication Data

US 2007/0125721 A1 Jun. 7, 2007

(30) Foreign Application Priority Data

Dec. 3, 2005 (DE) ..... 10 2005 057 861

(51) Int. Cl.
*B01D 33/04* (2006.01)
*D21F 3/04* (2006.01)
*F16J 15/16* (2006.01)
*F26B 13/00* (2006.01)

(52) U.S. Cl. ..... 210/400; 162/358.3; 162/358.5; 277/345; 34/618; 34/620

(58) Field of Classification Search ..... 210/400, 210/401; 162/358.1, 358.3, 358.4, 358.5, 162/900, 901; 277/345, 903; 34/94, 111, 34/123, 618, 620
See application file for complete search history.

(56) References Cited

U.S. PATENT DOCUMENTS 4,124,942 A * 11/1978 Ohls et al. ..... 34/115
4,343,591 A * 8/1982 Hannan et al. ..... 415/175
4,461,095 A * 7/1984 Lehtinen ..... 34/392
4,915,787 A * 4/1990 Branyon et al. ..... 162/199
5,471,765 A 12/1995 Rautakorpi et al. ..... 34/242
6,189,233 B1 * 2/2001 Halmschlager et al. ..... 34/117
6,395,137 B1 * 5/2002 Snellman ..... 162/371
2004/0056423 A1 * 3/2004 Staljanssens ..... 277/305

FOREIGN PATENT DOCUMENTS

| | | |
|---|---|---|
| EP | 1 496 153 | 1/2005 |
| JP | 2005-300144 | * 10/2005 |
| WO | WO 93/15268 | * 8/1993 |
| WO | WO 2005/100682 | 10/2005 |

* cited by examiner

*Primary Examiner*—Fred Prince
(74) *Attorney, Agent, or Firm*—Taylor & Aust, P.C.

(57) ABSTRACT

This invention relates to an arrangement for sealing off a fluid-filled, stationary pressurized compartment from an endlessly circulating, impermeable belt of a machine for producing and/or refining a paper, paperboard, tissue or other fibrous web with the help of at least one seal of the pressurized compartment, whose contact pressure toward the belt is variable, wherein the belt is pressed by the pressurized compartment against a co-driven support element and the fibrous web runs alone or jointly with one or more function belts between the belt and the support element. The sealing is improved in this case, while producing as little leakage and wear as possible, in that the contact pressure of the seal is controlled as a factor of the drive power and/or the drive torque channeled into the belt and/or as a factor of the leakage of fluid through the gap between the seal and the belt and/or as a factor of the pressure of the fluid in the pressurized compartment.

18 Claims, 2 Drawing Sheets

SEALING ARRANGEMENT

BACKGROUND OF THE INVENTION

1. Field of the Invention

This invention relates to an arrangement for sealing off a fluid-filled, stationary pressurized compartment from an endlessly circulating, impermeable belt of a machine for producing and/or refining a paper, paperboard, tissue or other fibrous web with the help of at least one seal of the pressurized compartment, whose contact pressure toward the belt is variable, wherein the belt is pressed by the pressurized compartment against a co-driven support element and the fibrous web runs alone or jointly with one or more function belts between the belt and the support element.

2. Description of the Related Art

Seals of this type are subject to very high wear.

To limit the wear it is desirable for there to be an at least slight leakage of the fluid between the seal and the belt for lubrication. However, to avoid impairing the machine or the fibrous web this leakage should not exceed a certain amount.

The sealing effect is also influenced in this case by faults or swellings which run together with the belt or the fibrous web through the sealing gap.

What is needed in the art is to improve the sealing effect while producing as little leakage and wear as possible.

SUMMARY OF THE INVENTION

According to the present invention, the contact pressure of the seal is controlled as a factor of the drive power and/or the drive torque channeled into the belt.

Thereby it was discovered that the drive power and/or the drive torque of the drive of the belt and/or the support element fluctuates as a factor of the sealing effect. While a large leakage leads to good lubrication of the gap between the belt and the seal and hence requires a lower drive power/torque, a small leakage leads to increased wear due to friction on the belt and seal and thus requires a higher drive power/torque.

Therefore, given a constant speed of the belt and a rapid drop of the drive power and/or the drive torque, the contact pressure of the seal should be increased. This improves the sealing effect, thus reducing the leakage of the fluid until the desired state of the drive power/torque is reached.

Conversely, i.e. given a constant speed of the belt and a rapid rise of the drive power and/or the drive torque, the contact pressure of the seal should be decreased.

This allows a larger leakage again and hence an improved lubrication of the sealing gap between the belt and the seal. This usually occurs when swellings run through the gap between the belt and the support element.

Alternatively to or in combination with this it can also be advantageous for the contact pressure of the seal to be controlled as a factor of the leakage of fluid through the gap between the seal and the belt.

Due to the direct relationship between the leakage rate and the wear and the drive power/torque, the contact pressure of the seal should be raised, given increasing leakage, until the desired state of the leakage is reached.

Conversely, the contact pressure of the seal should be lowered, given decreasing leakage, until the desired state of the leakage is reached.

Alternatively to or in conjunction with the controlling as a factor of the leakage rate and/or the drive power/torque it can also be advantageous for the contact pressure of the seal to be controlled as a factor of the pressure of fluid in the pressurized compartment.

This takes account of the direct relationship between the pressure in the pressurized compartment and the leakage rate.

Therefore, the contact pressure of the seal should be raised given an increase of the fluid pressure in the pressurized compartment and be lowered given a decrease of the fluid pressure in the pressurized compartment.

In this way the leakage rate of the fluid can be influenced such that a maximum amount is not overshot and, on the other hand, a minimum amount for guaranteeing sufficient lubrication and hence the least possible wear is not undershot.

With the combination of two or three of the inventive control procedures it has proven to be advantageous, in the lower range of the drive torque possible during operation, for the contact pressure to be controlled mainly or exclusively as a factor of the leakage rate of fluid.

In addition, it is an advantage in this case, in the upper range of the drive torque possible during operation, for the contact pressure to be controlled mainly or exclusively as a factor of the drive torque.

For certain applications it can be advantageous for the belt in the region of the pressurized compartment to run straight.

In this case the support element should be formed by a counter-belt which is pressed by at least one pressurized compartment toward the belt. However, it can also be an advantage for the belt in the region of the pressurized compartment to run curved in the belt running direction.

In this case the support element should be formed by a rotating support roller.

The press nip formed by the belt and the support element can be used for smoothing the fibrous web.

However, if the press nip is used to dewater the fibrous web, then all function belts, or at least one, should be constructed as water-absorbing.

To reduce the stress on the units, the fluid pressure in the pressurized compartment and the contact pressure of the seal should be reduced when the belt is at a standstill.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplification set out herein illustrates one embodiment of the invention, in one form, and such exemplification is not to be construed as limiting the scope of the invention in any manner.

DETAILED DESCRIPTION OF THE INVENTION

Figure 1:
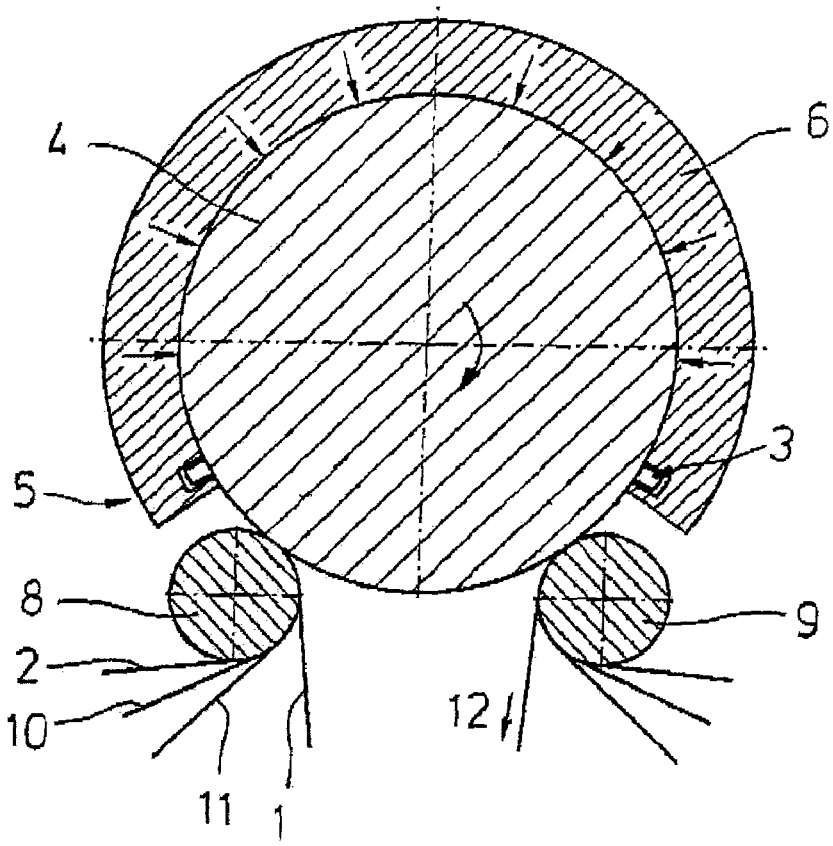
FIG. 1 shows a schematic cross section through a drying arrangement.

Referring now to the drawings, and more particularly to FIG. 1, there is shown the drying arrangement for drying the fibrous web 1 which is formed by a support element 4 in the form of a cylindrical, rotating and heated support roller and an impermeable belt 2 enwrapping the support roller.

In addition to the fibrous web 1, two water-absorbing function belts 10, 11 are passed through the press nip formed by the belt 2 and the support roller such that they run between the fibrous web 1 and the belt 2.

Arranged in the wrap zone of the belt 2 opposite the support roller is a pressure hood 5 which has a fluid-filled pressurized compartment 6. This pressurized compartment 6 is sealed off from the belt 2 by way of seals 3 such that the fluid of the pressurized compartment 6 open to the belt 2 presses the belt 2 toward the circumferential surface of the support roller.

In this case the belt 2 is cooled by way of the fluid, resulting in increased condensation in the water-absorbing function belts 10, 11. The water vaporized out of the fibrous web 1 due to the heating by the support roller can thus be discharged easily by way of the function belts 10, 11.

Upstream and downstream from the pressure hood 5 the belt 2 is pressed against the support roller by one guide roller 8, 9 respectively. This leads to compression of the gap between the belt 2 and the support roller and improves the conveyance of the belts 2, 10, 11.

Because the pressure hood 5 is arranged stationary, the seal 3 toward belt 2 must be lubricated. This is done in this case by a leakage of the fluid, in this case water from the pressurized compartment 6.

To guarantee sufficient lubrication of the sealing gap between belt 2 and seal 3, the leakage rate should be greater than a minimum amount. Furthermore, too great a contact pressure of the seal 3 results not only in increased wear but also in a higher drive power or a higher drive torque for driving the belt 2.

However, to avoid impairing the function of the drying arrangement and the fibrous web 1 the leakage rate is not allowed to be too high.

The pressure in the pressurized compartment lies between 0.3 and 5 bar.

Figure 2:
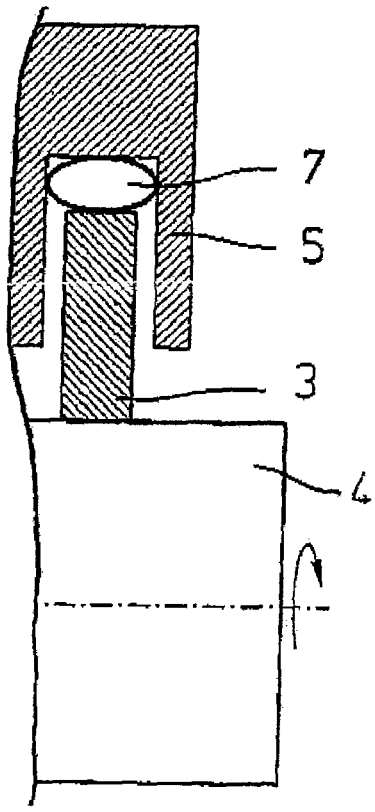
FIG. 2 shows a detailed view of the drying arrangement.

Seals 3 are located at the edges of the pressurized compartment 6, wherein the seals 3 particularly at the inlet and outlet of the belt 2, as shown in FIG. 2, are pressed by a pressure hose 7 against the belt 2. The contact pressure of the seal 3, which is controllable by way of the pressure hose 7, influences the effect of the seal 3 and hence also the leakage rate of the fluid through the sealing gap.

The pressure in the pressure hose 7 and hence the contact pressure of the seal 3 are raised given a constant belt speed but rapidly falling drive power or drive torque of the belt drive. As a rule, the reduced drive power or drive torque is strong evidence of too large a fluid leakage.

Conversely, the pressure and the contact pressure of the seal 3 are lowered given a constant belt speed but rapidly rising drive power or drive torque of the belt drive. The increased drive power or drive torque points to an increased friction in the sealing gap and/or to the passage of swellings.

For this purpose the belt drive and pressure hose 7 are connected to a controller.

Given low drive powers or drive torques, however, the contact pressure of the seal 3 is controlled by way of the pressure hose 7 as a factor of the leakage rate through the sealing gap between the belt 2 and the seal 3.

If the leakage rate per unit of time is too high, then the contact pressure of the seal 3 will be increased; if the leakage rate per unit of time is too low and therefore insufficient leakage exists, then the contact pressure of the seal 3 will be reduced.

For this purpose the leakage rate of the fluid per unit of time must be recorded by way of suitable sensors.

When the belt 2 is at a standstill, the fluid pressure in the pressurized compartment 6 and the contact pressure of the seal 3 are reduced.

The seal 3 can also include of two or more sub-seals arranged one after the other in the belt running direction 12, of which one or more are pressed toward the belt 2.

Figure 3:
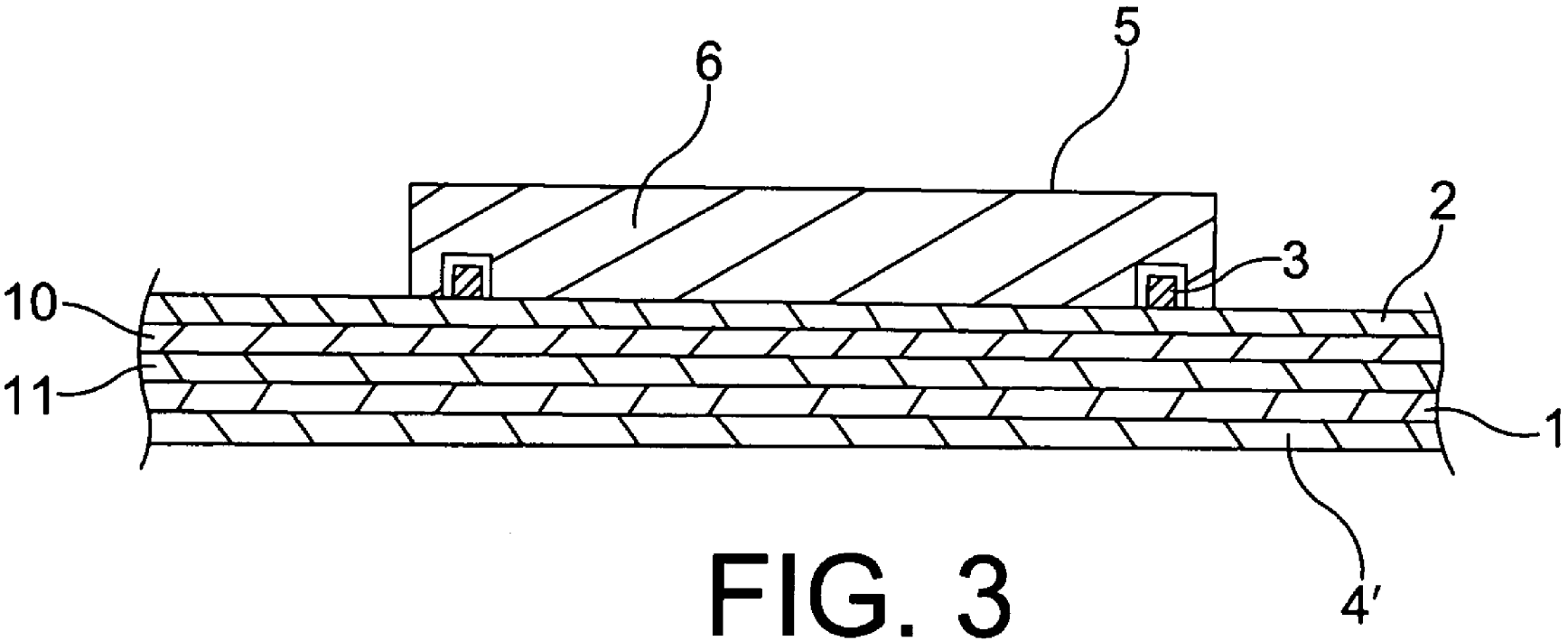
FIG. 3 shows a schematic cross section through a drying arrangement according to another embodiment of the present invention.

FIG. 3 shows belt 2 in the region of pressurized compartment 6 running straight. In this case the support element is formed by a counter-belt 4'.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An arrangement for sealing off a fluid-filled, stationary pressurized compartment from an endlessly circulating, impermeable belt of a machine for at least one of producing and refining a fibrous web, said arrangement comprising:

at least one seal of the pressurized compartment, said at least one seal defining a contact pressure toward the belt, said contact pressure being variable;

a co-driven support element, the belt pressed by the pressurized compartment against said co-driven support element; and at least one function belt, the fibrous web running one of alone and jointly with said at least one function belt between the belt and said support element;

wherein the machine channels into the belt at least one of a drive power and a drive torque, said contact pressure of said at least one seal varying as a factor of said at least one of said drive power and said drive torque channeled into the belt.

2. The arrangement according to claim 1, wherein said contact pressure is increased when the belt comprises a constant speed and said at least one of said drive power and said drive torque rapidly drops.

3. The arrangement according to claim 1, wherein said contact pressure is reduced when the belt comprises a constant speed and said at least one of said drive power and said drive torque rapidly rises.

4. An arrangement for sealing off a fluid-filled, stationary pressurized compartment from an endlessly circulating, impermeable belt of a machine for at least one of producing and refining a fibrous web, said arrangement comprising:

at least one seal of the pressurized compartment, said at least one seal defining a contact pressure toward the belt, said contact pressure being variable;

a co-driven support element, the belt pressed by the pressurized compartment against said co-driven support element; and at least one function belt, the fibrous web running one of alone and jointly with said at least one function belt between the belt and said support element;

wherein said at least one seal and the belt define a gap through which is a leakage of a fluid, said contact pressure of said at least one seal varying as a factor of said leakage of said fluid through said gap between said at least one seal and the belt.

5. The arrangement according to claim 4, wherein said contact pressure is raised when said leakage increases.

6. The arrangement according to claim 4, wherein said contact pressure is lowered when said leakage decreases.

7. An arrangement for sealing off at least one fluid-filled, stationary pressurized compartment from an endlessly circulating, impermeable belt of a machine for at least one of producing and refining a fibrous web, said arrangement comprising:

at least one seal of the pressurized compartment, said at least one seal defining a contact pressure toward the belt, said contact pressure being variable;

a co-driven support element, the belt pressed by the pressurized compartment against said co-driven support element; and at least one function belt, the fibrous web running one of alone and jointly with said at least one function belt between the belt and said support element;

wherein the machine channels into the belt at least one of a drive power and a drive torque, said contact pressure of said at least one seal varying as a factor of said at least one of said drive power and said drive torque channeled into the belt and varying as a factor of the pressure of the fluid in the pressurized compartment.

8. The arrangement according to claim 7, wherein said contact pressure is raised when the fluid pressure in the pressurized compartment increases.

9. The arrangement according to claim 7, wherein said contact pressure is lowered when the fluid pressure in the pressurized compartment decreases.

10. The arrangement according to claim 7, further comprising a fluid including a leakage rate, wherein said drive torque includes a lower range possible during operation, said contact pressure controlled one of mainly and exclusively as a factor of said leakage rate of said fluid in said lower range of said drive torque possible during operation.

11. The arrangement according to claim 7, wherein said drive torque includes an upper range possible during operation, said contact pressure controlled one of mainly and exclusively as a factor of said drive torque in said upper range of said drive torque possible during operation.

12. The arrangement according to claim 7, wherein the arrangement defines a region of the pressurized compartment, the belt running straight in said region of the pressurized compartment.

13. The arrangement according to claim 12, wherein said support element comprises a counter-belt which is pressed.

14. The arrangement according to claim 12, wherein said support element comprises a counter-belt which is pressed by at least one pressurized compartment toward the belt.

15. The arrangement according to claim 7, wherein the arrangement defines a region of the pressurized compartment and the belt includes a running direction, the belt running curved in said belt running direction in said region of the pressurized compartment.

16. The arrangement according to claim 15, wherein said support element comprises a rotating support roller.

17. The arrangement according to claim 7, wherein said at least one function belt is water-absorbing.

18. The arrangement according to claim 7, wherein the fluid pressure in the pressurized compartment and said contact pressure of said at least one seal are reduced when the belt is at a standstill.

* * * * *